US008840051B2

(12) United States Patent
Goodes et al.

(10) Patent No.: US 8,840,051 B2
(45) Date of Patent: Sep. 23, 2014

(54) METHOD AND APPARATUS FOR REDUCING THE SIZE OF MATERIALS

(75) Inventors: Christopher Geoffrey Goodes, Hampton (AU); Grant Ashley Wellwood, Pheasant Creek (AU)

(73) Assignee: Technological Resources Pty. Limited, Melbourne, Victoria (AU)

( * ) Notice: Subject to any disclaimer, the term of this patent is extended or adjusted under 35 U.S.C. 154(b) by 432 days.

(21) Appl. No.: 13/133,644

(22) PCT Filed: Dec. 8, 2009

(86) PCT No.: PCT/AU2009/001587
§ 371 (c)(1), (2), (4) Date: Sep. 22, 2011

(87) PCT Pub. No.: WO2010/065988
PCT Pub. Date: Jun. 17, 2010

(65) Prior Publication Data
US 2012/0018550 A1 Jan. 26, 2012

(30) Foreign Application Priority Data
Dec. 8, 2008 (AU) ..... 2008906337

(51) Int. Cl.
*B02C 19/18* (2006.01)
*B02C 4/02* (2006.01)

(52) U.S. Cl.
CPC .. *B02C 4/02* (2013.01); *B02C 19/18* (2013.01)
USPC ..... 241/1; 241/301

(58) Field of Classification Search
USPC ..... 241/1, 301, 21
See application file for complete search history.

(56) References Cited

U.S. PATENT DOCUMENTS

| | | | | |
|---|---|---|---|---|
| 3,208,674 | A * | 9/1965 | Bailey | 241/1 |
| 3,460,766 | A | 8/1969 | Sarapuu | |
| 3,580,637 | A * | 5/1971 | Itoh et al. | 299/14 |
| 4,313,573 | A | 2/1982 | Goldberger et al. | |
| 4,653,697 | A * | 3/1987 | Codina | 241/1 |

FOREIGN PATENT DOCUMENTS

GB 2 421 203 B 4/2008

OTHER PUBLICATIONS

International Search Report from the Australian Patent Office for International Application No. PCT/AU2009/001587, mailed Feb. 11, 2010.

* cited by examiner

*Primary Examiner* — Mark Rosenbaum
(74) *Attorney, Agent, or Firm* — Banner & Witcoff, Ltd.

(57) ABSTRACT

A method of reducing the size of material, such as rocks of mined ore, is disclosed. The method comprises comminuting and electro-fracturing rocks of the material and thereby reducing the rock size.

9 Claims, 1 Drawing Sheet

HPGR & elecro fracturing.

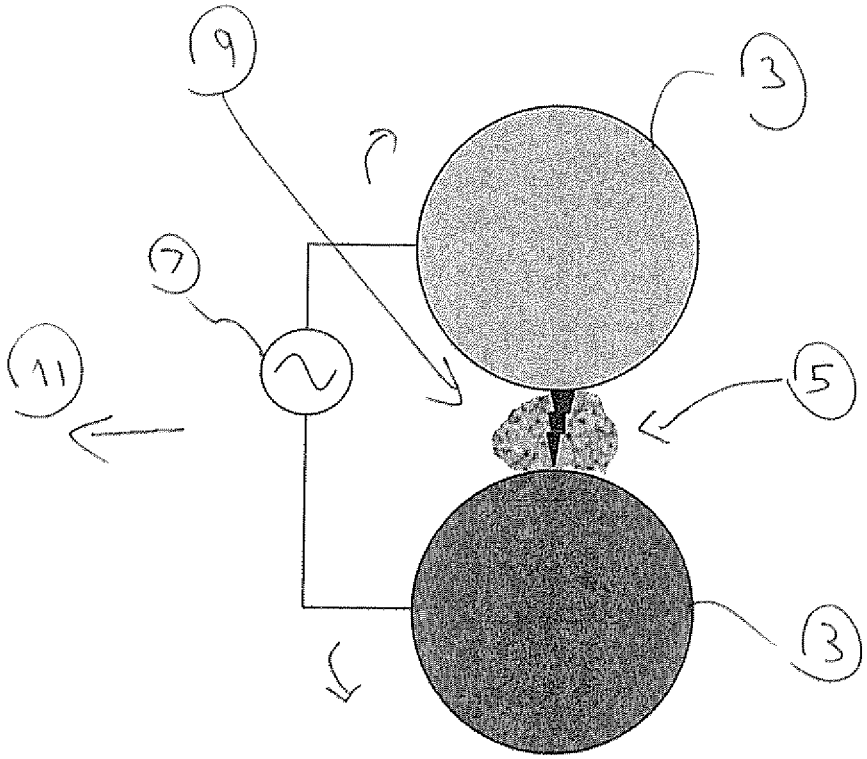
HPGR & elecro fracturing.

METHOD AND APPARATUS FOR REDUCING THE SIZE OF MATERIALS

The present invention relates to a method and an apparatus for reducing the size of materials.

The materials may be any materials that require size reduction.

By way of example, the materials may be mined materials, such as mined ore.

The present invention relates particularly, although by no means exclusively, to a method and an apparatus for reducing the size of mined ore, such as ore containing valuable minerals.

Conventional comminution of ores, such as by mechanical grinding, is usually the most energy intensive activity in mineral concentration flowsheets for separating valuable minerals from gangue in ores, consuming around 30-50% of the total energy requirements. In this context, the term "comminution" is understood to mean breaking, crushing or grinding of ores. In plants that process very hard ores this value can be as high as 70%. Therefore, in the context of theoretical energy efficiencies of less than 5%, comminution is an obvious focus for improvement. Mechanical grinding processes also provide little control over the degree of particle breakdown. The ideal comminution method liberates valuable minerals from gangue at the largest grain size possible. The current comminution methods known to the applicant are indiscriminate and in most cases over-grind both the mineral and the gangue which creates issues in the downstream recovery and waste management steps.

The present invention is based on a realisation that an improved size reduction method, which is not subject to the poor energy efficiency and over-grinding associated with mechanical grinding discussed above, is a method that synergistically combines two alternate approaches for achieving size reduction, namely, (a) electro-fracturing rocks and (b) comminuting rocks, into a single method step.

The term "electro-fracturing" is understood herein to mean the use of electrical energy to cause cracking (for example, micro-cracking) and then fracturing of materials.

According to the present invention there is provided a method of reducing the size of a material which comprises comminuting and electro-fracturing rocks of the material.

The method may comprise supplying rocks of the material to a comminution apparatus and comminuting the rocks in the apparatus and electro-fracturing the rocks while the rocks are in the apparatus.

Alternatively, the method may comprise supplying rocks of the material to a comminution apparatus and comminuting the rocks in the apparatus and thereafter electro-fracturing the rocks in a downstream method step after the rocks have been comminuted in the apparatus.

The step of electro-fracturing the rocks may comprise passing an electrical current through rocks as the rocks are being comminuted in the comminution apparatus and generating internal stresses in the rocks that cause further fracturing of rocks.

The pressure on rocks that is generated in the comminution apparatus causes the rocks to fracture into finer particles. The use of an electrical current establishes an electrical current path through naturally occurring lower resistance paths in the rocks. The current causes resistance heating and ultimately vaporisation and expansion of liquids contained within the rock, which generates internal stresses that result in the rocks fracturing at the grain size level, thereby promoting mineral liberation at a coarse size.

The electrical current may be alternating current or direct current.

The electrical current may be short bursts of electrical current at high power.

The electrical current may be pulses of current current at high power.

The requirements for the electrical current pulses, such as frequency, pulse duration, and power, in any given situation will vary considerably with different materials and can be determined by experimentation having regard to the functional requirement of generating internal stresses that result in fracturing rocks.

The comminution apparatus may be any suitable apparatus. Examples of suitable apparatus include roll crushers, jaw crushers, gyratory crushers and impact crushers.

By way of example, the comminution apparatus may comprise a pair of crushing rolls having a nip between the rolls and being adapted to crush rocks in the nip.

The method may comprise using crushing rolls that have roll surfaces that are electrically conductive and electrically isolating the rolls to facilitate passing electrical current through rocks in the nip via the roll surfaces. When the rocks are in the nip and contact the roll surfaces directly or indirectly, they are in intimate contact with an electrical conducting surface on opposed sides of the rock. Consequently, the assembly of the rotating rolls is well suited for electro-fracturing rocks.

The method may comprise electrically isolating axial segments of the crushing rolls to create axially-spaced multiple and separately controllable cylindrical sections for passing electrical current through the rock.

The crushing rolls may be high pressure grinding rolls.

The crushing rolls may be counter-rotating or contra-rotating rolls.

The method may comprise treating the rocks prior to electro-fracturing the rocks to improve the electrical conductivity of the rocks or to otherwise improve electro-fracturing of the rocks.

By way of example, the treatment step may comprise wetting the rocks, for example by spraying the rocks, with a liquid. This is a particularly suitable option when the rocks are porous and the liquid can penetrate the rock, via the pores and be vaporised by the resistance heating caused by the electrical current and contribute to internal stresses in the rocks.

According to the present invention there is also provided an apparatus for reducing the size of a material which comprises a comminution apparatus for comminuting rocks of the material and an electro-fracturing apparatus for fracturing the rocks.

The comminution apparatus may comprise a pair of rotating crushing rolls separated by a nip for fracturing rocks in the nip and a drive assembly for rotating the rolls.

The electro-fracturing apparatus may comprise an assembly for passing electrical current through rocks as the rocks pass through the nip to generate internal stresses in the rocks in the nip to further fracture the rocks in the nip.

The crushing rolls may be backed up by back-up rolls.

In addition to facilitating the application of electro-fracturing to individual rocks the present invention has a number of other benefits including the following benefits.

The rocks are under extreme pressure in the comminution apparatus, such as when in the nip between two crushing rolls, particularly high pressure grinding rolls. The phases within the stressed rock will therefore experience piezoresistive effects (stress dependent resistivity of the material). The solids should be less resistive to electrical charge and therefore easier to electro-fracture.

The electrical current associated with electro-fracturing rocks finds the lowest resistance pathway through the rocks. This is significant in many situations, for example when the material being processed is ore that contains valuable minerals and gangue. Specifically, mineral phases within such ore rocks have vastly greater dielectric constants than the gangue and hence the path of the electrical current would most likely include the mineral phases. While the mineral phases are the preferred path for passing electrical current, they still have appreciable resistivity which will cause them to heat rapidly with respect to the surrounding gangue phase. This will in turn create thermally induced stresses at the mineral-gangue grain boundaries which, particularly in the context of the pressure applied by comminution apparatus, such as crushing rolls, particularly high pressure grinding rolls, should promote fracture at the grain-gangue interfaces, which is the most desirable outcome.

By monitoring the instantaneous pressure being applied by comminution apparatus, such as the pressure being applied to crushing rolls, it may also be possible to supply the electrical current on-demand only or in proportion to the pressure being exerted. Therefore, hard rocks that resist comminution could be preferentially treated with an electrical current to augment comminution.

The present invention is described further with reference to the accompanying drawing which is a schematic representation, in simplified terms, of one embodiment of an apparatus for reducing the size of rocks of a material in accordance with the present invention.

With reference to the drawing, feed material in the form of a rocks 5 (only one of which is shown to simplify the drawing) of an ore that contains valuable minerals (such as copper-containing minerals) and gangue is supplied to a comminution apparatus in the form of a pair of counter-rotating crushing rolls 3, typically high pressure grinding rolls, and passes through a nip 9 that separates the rolls 3 in the direction of the arrow 11 and is crushed by the rolls. The rolls 3 are driven by a motor (not shown). The rolls have electrically conductive surfaces.

In addition, the apparatus shown in the drawing also includes an electro-fracturing apparatus in the form of an electrical circuit that comprises a power source 7, the surfaces of the rolls 3, and the rock 5. The electrical circuit passes pulses of electrical current through the rock 5 and generates internal stresses within the rock in the nip that causes electro-fracturing of the rock. The internal stresses are the result of electrical resistance heating that causes vaporisation of liquids in the rock. The frequency of the pulses, the pulse duration, and the energy of the pulses are selected to maximise energy-efficient electro-fracturing of the rock.

The combination of the pressure applied by the grinding rolls 3 and the electro-fracturing of the rock caused by the pulses of electrical current has the effect of efficiently reducing the size of the rock.

Many modifications may be made to the embodiment of the present invention described above without departing from the spirit and scope of the invention.

For example, whilst the embodiment is described in the context of reducing the size of mined ore, the present invention is not so limited and extends to any suitable application in which it is necessary to reduce the size of materials.

In addition, whilst the embodiment is described in the context of passing pulses of electrical current through the rock, the present invention is not so limited and the electrical current need not necessarily be pulsed.

In addition, whilst the embodiment is described in the context of the use of one pair of crushing rolls, the present invention is not so limited and extends to the use of back-up rolls in conjunction with the rolls in the pair and to successive pairs of rolls that progressively reduce the size of the material.

In addition, whilst the embodiment is described in the context of the use of a pair of crushing rolls, the present invention is not limited to the use of this type of comminution apparatus.

In addition, whilst the embodiment is described in the context of simultaneous comminuting and electro-fracturing of rocks, the present invention is not so limited and extends to arrangements in which the electro-fracturing step is carried out as a downstream step after a step of comminuting rocks.

The invention claimed is:

1. A method of reducing the size of a material which comprises supplying rocks of the material to a comminution apparatus and simultaneously comminuting and electro-fracturing the rocks in the apparatus; wherein comminuting comprises crushing or grinding using crushing rolls having roll surfaces that are electrically conductive and electrically isolating the rolls to facilitate passing electrical current through rocks in the nip via the roll surfaces whereby, when the rocks are in the nip and contact the roll surfaces directly or indirectly, they are in intimate contact with an electrical conducting surface on opposed sides of the rock.

2. The method defined in claim 1 wherein the electro-fracturing the rocks comprises generating internal stresses in the rocks that cause further fracturing of rocks.

3. The method defined in claim 1 wherein the electrical current is in short bursts of electrical current at high power.

4. The method defined in claim 1 comprises electrically isolating axial segments of the crushing rolls to create axially-spaced multiple and separately controllable cylindrical sections for passing electrical current through the rock.

5. The method defined in claim 1 comprises treating the rocks prior to electro-fracturing the rocks to improve the electrical conductivity of the rocks or to otherwise improve electro-fracturing of the rocks.

6. The method defined in claim 5 wherein the treatment step comprises wetting the rocks with a liquid.

7. The method defined in claim 6 wherein the wetting the rocks comprises spraying the rocks.

8. An apparatus for reducing the size of a material which comprises a comminution apparatus comprising a pair of rotating crushing rolls separated by a nip for fracturing rocks in the nip and a drive assembly for rotating the rolls for comminuting rocks of the material and an electro-fracturing apparatus for fracturing the rocks wherein the comminution apparatus and electro-fracturing apparatus provide simultaneous comminuting and electro-fracturing of the rocks; wherein comminuting comprises crushing or grinding.

9. The apparatus defined in claim 8 wherein the electro-fracturing apparatus comprises an assembly for passing electrical current through rocks as the rocks pass through the nip to generate internal stresses in the rocks in the nip to further fracture the rocks in the nip.

* * * * *